US009085172B2

(12) United States Patent
Kato et al.

(10) Patent No.: US 9,085,172 B2
(45) Date of Patent: Jul. 21, 2015

(54) RECORDING METHOD AND RECORDING APPARATUS

(71) Applicant: CANON KABUSHIKI KAISHA, Tokyo (JP)

(72) Inventors: Masao Kato, Kawasaki (JP); Kentarou Muro, Tokyo (JP); Susumu Hirosawa, Tokyo (JP); Yutaka Kano, Yokohama (JP); Minoru Teshigawara, Saitama (JP); Yoshiaki Murayama, Tokyo (JP); Shigeyasu Nagoshi, Yokohama (JP); Minako Kato, Kawasaki (JP); Takeshi Murase, Yokohama (JP); Satoshi Azuma, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/585,751

(22) Filed: Dec. 30, 2014

(65) Prior Publication Data

US 2015/0151554 A1 Jun. 4, 2015

Related U.S. Application Data

(62) Division of application No. 12/965,758, filed on Dec. 10, 2010.

(30) Foreign Application Priority Data

Jun. 8, 2010 (JP) ..... 2010-131255

(51) Int. Cl.
*B41J 11/00* (2006.01)

(52) U.S. Cl.
CPC ..... *B41J 11/0015* (2013.01)

(58) Field of Classification Search
CPC ..... B41J 11/0015
USPC ..... 347/16, 17, 101, 102, 155
See application file for complete search history.

(56) References Cited

U.S. PATENT DOCUMENTS

| | | | | |
|---|---|---|---|---|
| 6,390,618 | B1 * | 5/2002 | Wotton et al. | 347/102 |
| 6,536,863 | B1 * | 3/2003 | Beauchamp et al. | 347/17 |
| 2004/0179080 | A1 * | 9/2004 | Hasebe et al. | 347/102 |

FOREIGN PATENT DOCUMENTS

| | | | |
|---|---|---|---|
| JP | 04-345447 | A | 12/1992 |
| JP | 2000-255053 | A | 9/2000 |
| JP | 2006-044021 | A | 2/2006 |
| JP | 2006-095774 | A | 4/2006 |
| JP | 2008-023822 | A | 2/2008 |
| JP | 2009-208415 | A | 9/2009 |

* cited by examiner

*Primary Examiner* — Lam Nguyen
(74) *Attorney, Agent, or Firm* — Canon USA, Inc. IP Division

(57) ABSTRACT

A first humidified gas is supplied through a first supply port to a sheet. A second humidified gas is supplied to a space where nozzles of an inkjet recording head are exposed through a second supply port located at a position closer to the recording heads than the first supply port, to increase atmosphere humidity in the space. The sheet portion having a moisture content increased by the humidification in advance is advanced into the space having the increased atmosphere humidity, to record on the sheet using the inkjet recording head. An amount of humidification with the first humidified gas is set according to at least one recording condition.

3 Claims, 17 Drawing Sheets

RECORDING METHOD AND RECORDING APPARATUS

CROSS-REFERENCE TO RELATED APPLICATION

This application is a Divisional of U.S. application Ser. No. 12/965,758, filed Dec. 10, 2010, which claims priority from Japanese Patent Application No. 2010-131255 filed Jun. 8, 2010, which are hereby incorporated by reference herein in their entireties.

BACKGROUND OF THE INVENTION

1. Field of the Invention

The present invention relates to a recording method and recording apparatus capable of suppressing drying of ink in inkjet recording heads.

2. Description of the Related Art

Japanese Patent Application Laid-Open No. 2000-255053 discusses a method, in a printing apparatus in which inkjet recording heads are fixedly arranged in a line in the direction of sheet conveyance, for maintaining humidity of the inkjet recording heads and suppressing drying of ink by continuously supplying humidified gas toward a nozzle of each of the recording heads from the upstream side thereof.

A Sheet such as paper that has an equilibrium moisture content (the state at which the sheet is neither gaining nor losing moisture) that changes according to a humidity in the air: the sheet absorbs moisture at higher humidity, and releases moisture at lower humidity. When a sheet is fed to an area near recording heads, the area having a high humidity due to humidified air supplied thereto, the sheet starts to absorb moisture.

As a result, some drop in humidity in the atmosphere occurs, and may disturb appropriate moisturization of the recording heads. Especially in a configuration with a plurality of recording heads fixedly arranged in a line in the direction along which humidified air is introduced, it takes some time for the humidified gas to flow down the line, and the moisture is absorbed by the recording heads in the order arranged. This tends to make the humidity retention of the downstream recording heads insufficient.

In view of the above problem, a first object of the present invention is to provide a recording method and recording apparatus capable of maintaining recording heads at an appropriate moisture level and suppress drying of ink during recording operation. The drying level of ink during recording operation of a recording heads changes depending on various conditions for the recording. For example, a sheet has a different equilibrium moisture content depending on the type of the sheet for the same ambient conditions. The sheets for inkjet printing are generally formed of base paper such as resin coated paper (hereinafter, referred to as RC sheet) and paper based paper (hereinafter, referred to as baryta paper).

The RC paper is formed of base paper coated with resin, and absorbs less moisture in the fiber of the paper than baryta paper. In other words, different types of sheets have different moisture absorption properties (different amount and rate of moisture absorption). Accordingly, when a sheet having a moisture absorption property larger than expected is used, since it takes a period of time for humidified gas to flow down the line of recording heads, which is supplied from the upstream side of the recording heads, and moisture in the gas is absorbed by the sheet, the humidity of the recording heads on downstream side is likely to become insufficient.

In view of the above problem, a second object of the present invention is to provide a recording method and recording apparatus capable of moisturizing recording heads without fail independently of the recording conditions.

SUMMARY OF THE INVENTION

According to an aspect of the present invention, a method for recording on a sheet to be conveyed with a recording head of an inkjet type in which nozzles are formed includes supplying a first humidified gas to the sheet with a first supply port, supplying a second humidified gas to a space where the nozzles are exposed, with a second supply port located at a position closer to the recording head than the first supply port, recording in the space where atmosphere humidity is increased, using the recording head, on the sheet having a moisture content increased in the supplying the first humidified gas step, and setting an amount of humidification of the first humidified gas depending on at least one recording condition.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
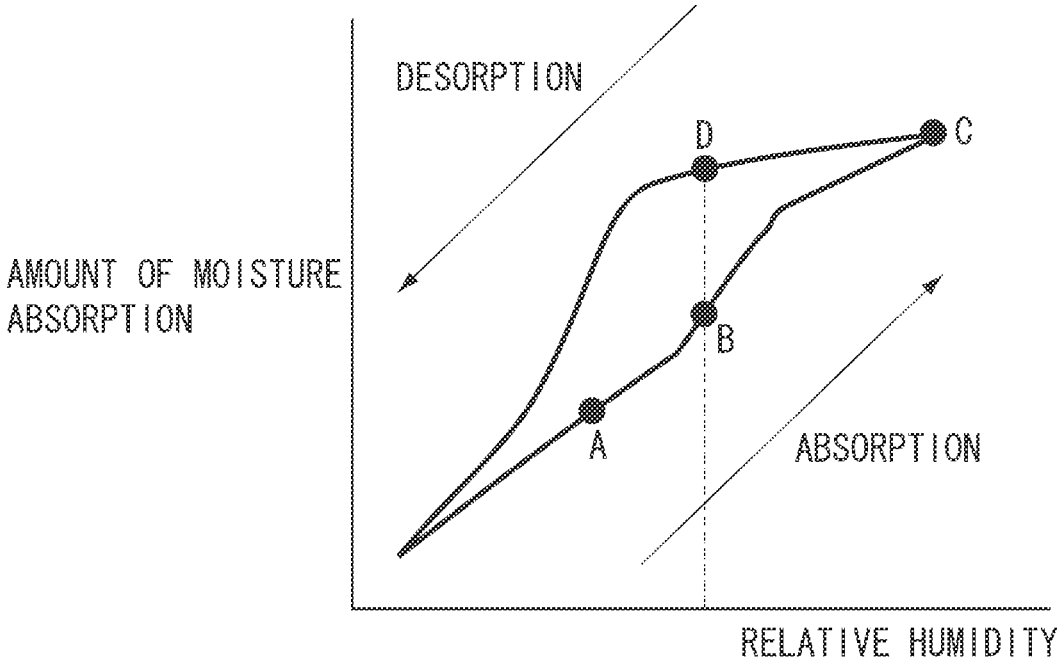
FIG. 1 illustrates hysteresis of sheets.

Prior to the description of exemplary embodiments of the present invention, first, hysteresis of a sheet as a recording medium, such as glossy paper for inkjet, is described. FIG. 1 illustrates hysteresis between absorption and desorption of moisture. For paper such as glossy paper for inkjet, the relationship between absorption and desorption of moisture as a function of relative humidity is not linear. As the atmosphere humidity changes from the point A to the point B, that is, as the relative humidity increases, the glossy paper for inkjet absorbs moisture in the atmosphere.

On the other hand, when the relative humidity decreases from the point C to the point B, the glossy paper for inkjet still contains an amount of moisture at the point D, which is larger than that at the point B. In other words, when glossy paper for inkjet is exposed to relative atmosphere humidity, the paper contains a larger amount of moisture when the relative humidity is decreased than when the relative humidity is increased.

In addition, the decrease in relative humidity from the point C to the point D causes smaller amount of desorption of moisture from the glossy paper for inkjet. Accordingly, when the paper is exposed again to a relative humidity equal to or more than that at the point C, the paper absorbs a less amount of moisture when the relative humidity at the point D is increased than that when the relative humidity at the point B is increased.

Thus, when a sheet is conveyed into a recording unit after the sheet is forced to absorb moisture, any absorption of moisture by the sheet in the recording unit can be restrained even when the unit is maintained at high relative humidity.

As a result, even when the relative humidity in the atmosphere around recording heads is increased to prevent evaporation of ink from the recording heads, the increased relative humidity can be maintained and the drying of ink can be suppressed, because absorption of moisture by the sheet is restrained. The present invention is based on such consideration.

Figure 2:
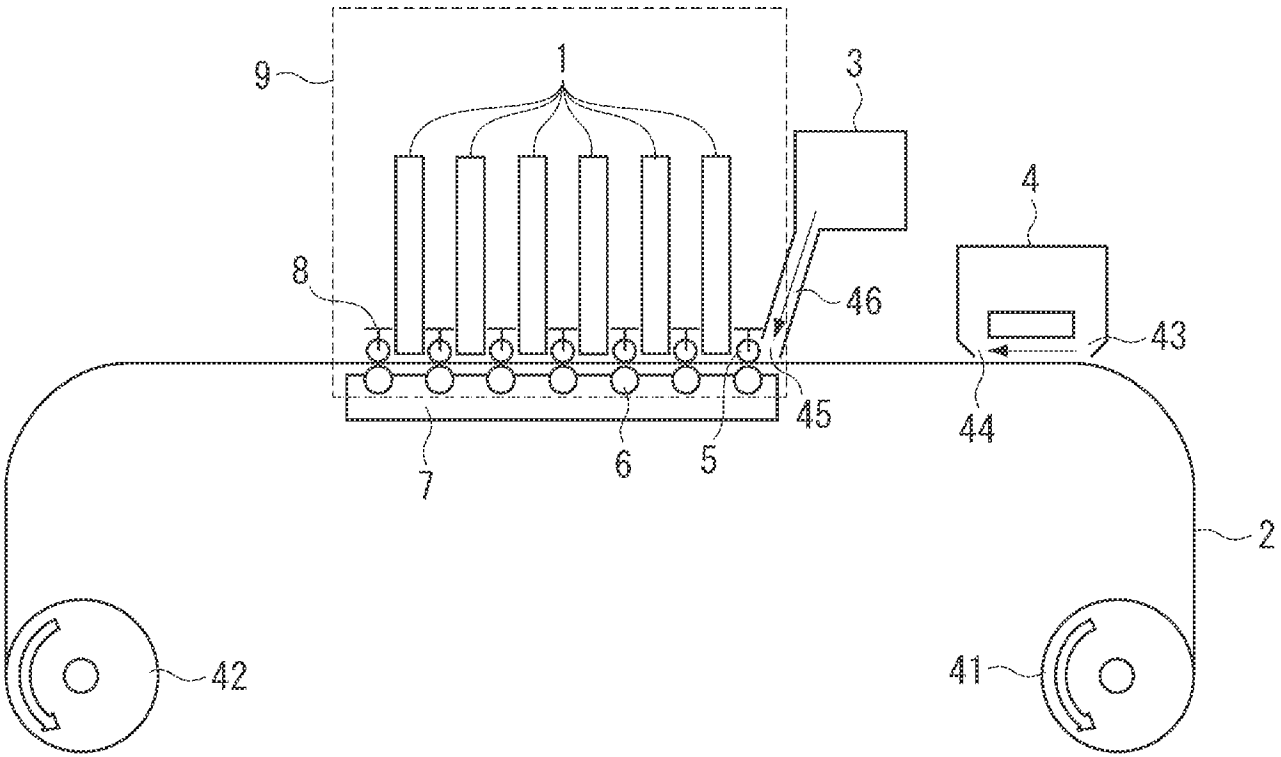
FIG. 2 illustrates a configuration of a recording apparatus according to a first exemplary embodiment.

FIG. 2 illustrates a configuration of a recording apparatus according to a first exemplary embodiment of the present invention, with the arrow indicating a flow of humidified gas. This exemplary embodiment uses humidified air, but any humidified gas may be used other than air. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The recording apparatus of this exemplary embodiment utilizes a roll-to-roll system. A sheet feeding unit 41 unwinds and feeds a continuous sheet 2. A winding rotary unit 42 rolls up the sheet after recording is performed thereon by a recording unit 9. The sheet feeding unit 41 in FIG. 2 includes one roll, but may includes a plurality of rolls for selective feeding of a sheet.

The recording unit 9 has a housing illustrated by the dotted line in FIG. 2, and a conveying mechanism and a recording unit are incorporated in the housing as a unit. The conveying mechanism includes a platen 7 for assistance of sheet support, and pairs of rolls, each pair consisting of a driving roller 6 and a driven roller 5. The driving rollers 6 are rotatably embedded in the platen 7, and rotated by a driving source to convey a sheet.

The driven rollers 5 are supported by a support member (holder) 8, and located at positions opposite to the driving rollers 6 respectively with a sheet therebetween. Between the pairs of the driving rollers 6 and the driven rollers 5, recording heads 1 are disposed as a recording unit. The recording heads 1 are full-line inkjet recording heads that are fixed and each have at least one nozzle to discharge ink in the width direction of a sheet across the maximum width of the sheet for recording.

This exemplary embodiment is described using a thermal inkjet printer, but is applicable to inkjet printers of piezoelectric element, electrostatic element, and micro electro mechanical system (MEMS) types for example.

The number of the recording heads 1 fixedly arranged in a line along the sheet conveyance direction is equal to that of colors (six in FIG. 2). The recording heads 1 are integrally supported by the supporting member 8. To the recording heads 1, ink is supplied from an ink supply unit (not illustrated) such as ink tanks. The recording heads 1 each may be a unit combined with an ink tank that stores ink of a corresponding color.

The recording unit 9 forms images in line printing process, by applying ink of corresponding colors using the recording heads 1 to a sheet while the sheet is moving. This exemplary embodiment is described using a roll sheet that is a continuous sheet, but sheets in other form may be used such as a continuous sheet that is folded into portions of a unit length, and cut sheets.

A first humidifying unit 4 (first humidifying unit) is provided upstream of the recording unit 9 along the sheet conveyance path. The first humidifying unit 4 humidifies a sheet before the sheet is conveyed to the recording unit 9. The first humidifying unit 4 supplies humidified gas (a first humidified gas) to the sheet before the sheet enters the recording unit 9, to increase moisture content of the sheets through absorption of moisture.

The first humidifying unit 4 includes a humidifying apparatus, a blower device, a supply port 43 (first supply port), and an intake port 44. A first gas in the first humidifying unit 4 is humidified by the humidifying apparatus, and is emitted from the supply port 43 by the blower device to be supplied to a sheet before the sheet enters the recording unit 9 (a first humidified gas). The intake port 44 may be provided at any position as long as it can take gas into the first humidifying unit 4.

The intake port 44 is provided at a distance from the supply port 43 along the sheet, and the supply port 43 is disposed in such a manner that the humidified gas is supplied therefrom in the direction substantially parallel to the sheet. The gas supplied from the supply port 43 can be suctioned into the intake port 44, and thereby circulation of the humidified gas can be achieved to reduce the amount of water used in the humidifying unit.

In addition to the first humidifying unit 4, a second humidifying unit 3 (second humidifying unit) is provided to humidify the narrow space where the nozzles of the plurality of recording heads 1 in the recording unit 9 are exposed. The second humidifying unit 3 introduces humidified gas (a second humidified gas) through a sheet entrance of the recording unit 9, so that the atmosphere humidity in the narrow space where the nozzles of the recording heads 1 are exposed is increased. This moisturizes the nozzles of the recording heads, and suppresses drying of the nozzles.

The second humidifying unit 3 is provided with the humidifying unit that also operates for the first humidifying unit 4, a blower device, and an intake port. The second humidifying unit 3 is connected to a supply duct 46 having, at the distal end thereof, a supply port 45 (a second supply port) to discharge humidified gas. The supply port 45 is located near the sheet entrance of the recording unit 9, and supplies humidified gas (the second humidified gas) to the narrow space in the recording unit 9.

The supply port 43 and the intake port 44 of the first humidifying unit 4 are located upstream of the supply port 45 of the second humidifying unit 3 relative to the recording unit 9. The gas humidified in the second humidifying unit 3 is introduced to the supply port 45 through the supply duct 46, and thereby a gas humidifying unit of the second humidifying unit 3 does not have to be located between the recording unit 9 and the first humidifying unit 4.

The humidified gas supplied from the second humidifying unit 3 flows along the sheet conveyance path and the narrow space therearound in the recording unit 9 from upstream to downstream. Specifically, around the positions of the recording heads 1, the humidified gas flows through the gap (hereinafter, referred to as a gap at recording) between the front end (the surface having a nozzle) of each of the recording heads 1 and the sheet. Between adjacent recording heads 1, the humidified gas flows through the gap between the support member 8 and the sheet.

In other words, the humidified gas passes through two different gaps to the most downstream recording head 1. The recording gap is usually only about 1 mm in the inkjet system. Thus, the flow rate of the humidified gas is increased when passing through the recording gap, which may adversely affect the impact precision of ink drops (i.e., main drops and satellite drops) discharged from the recording heads 1 for recording.

Accordingly, the humidified gas from the second humidifying unit 3 is desirably set to have a flow rate of 1 m/sec or less at the recording gap.

Figure 3:
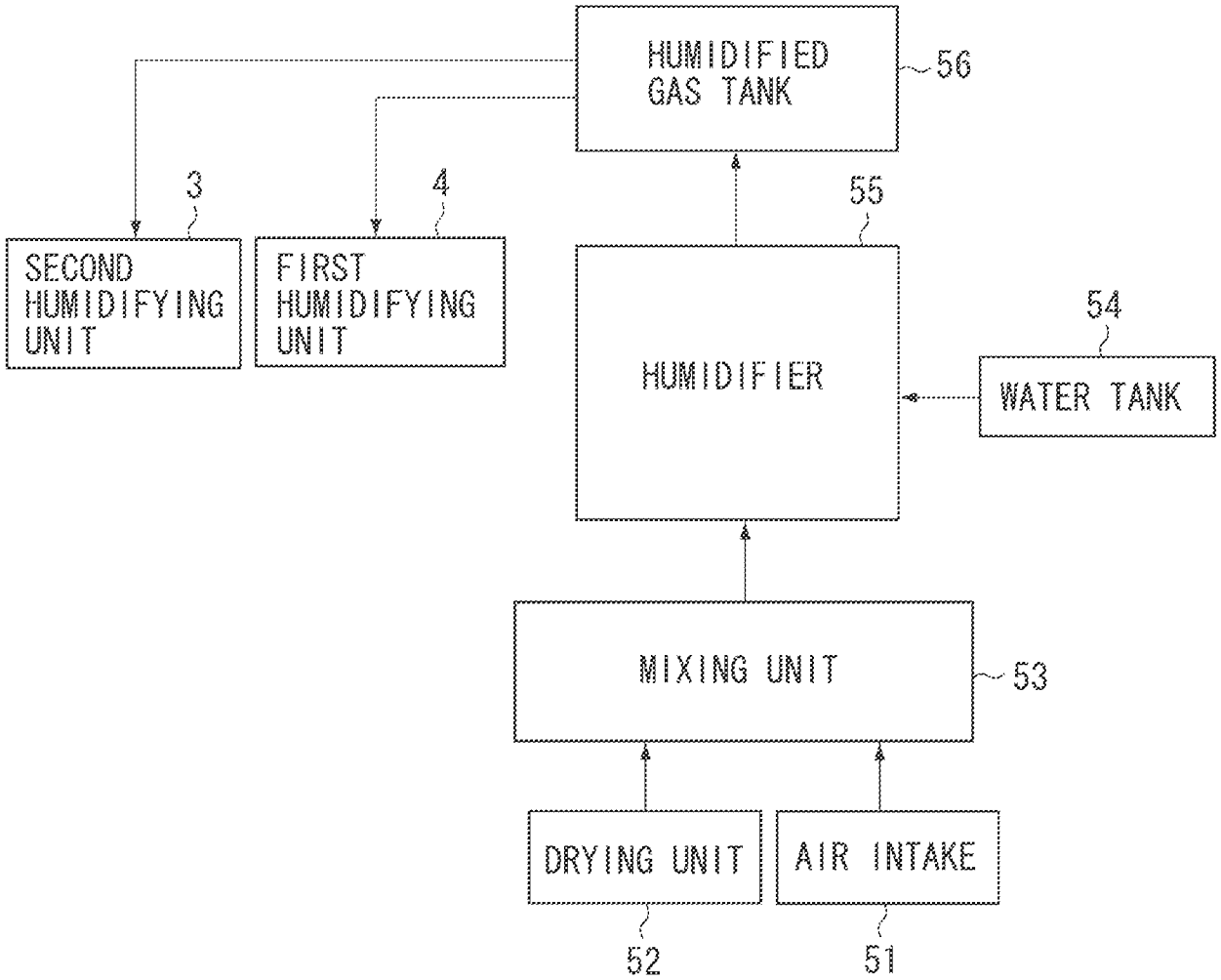
FIG. 3 is a system diagram illustrating a humidifying apparatus.

FIG. 3 is a system diagram illustrating the humidifying apparatus that supplies humidified gas to the first humidifying unit 4 and the second humidifying unit 3. The humidifying apparatus includes a mixing unit 53 where outside air from an air intake 51 and the discharged gas from a drying unit 52 are mixed to be a mixed humidified gas of an appropriate temperature.

The drying unit 52 (not illustrated in FIG. 2) dries the sheet that is wet with ink due to recording at the recording unit 9, before the sheet is rolled up by the winding rotary unit 42. The drying unit 52 discharges the highly humidified gas of high humidity and temperature, and part of the energy of the discharged gas is used to generate another humidified gas, which increases the energy efficiency of the overall apparatus. The humidifying apparatus further includes a humidifier 55 and a water tank 54. The mixed gas sent from the mixing unit 53 is mixed with water supplied from the water tank 54 to produce a humidified gas having appropriate temperature and humidity to be supplied to the sheet.

The humidified gas generated in the humidifier 55 is temporarily stored in a humidified gas tank 56. Then, for recording, the humidifying unit is activated to send a necessary amount of the humidified gas to the first humidifying unit 4 and the second humidifying unit 3 so that the sheet can be humidified as required. Between the mixing unit 53 and the humidifier 55, a heater is provided to finely control temperatures of the mixed gas and the humidified gas.

Now, the humidity levels of the first humidified gas supplied from the first humidifying unit 4 and the second humidified gas supplied from the second humidifying unit 3 are described.

The humidity in the atmosphere around the recording heads 1 needs to be at a level at which ink is unlikely to evaporate from the recording heads 1. For example, for a temperature from 30 to 40° C., the corresponding relative humidity is about 60 to 70%. Thus, the second humidifying unit 3 is desirably set to have a relative humidity of about 60 to 70%, but may have other relative humidity that suppresses the evaporation of ink from the recording heads 1.

The first humidifying unit 4 desirably causes the sheet to absorb moisture until it reaches the equilibrium moisture content. The maximum moisture content is different depending on the sheet types. As a standard value, the gas having an absolute humidity equal to or more than that of the humidified gas supplied from the second humidifying unit 3 can be supplied to the sheet from the first humidifying unit 4.

Figure 4:
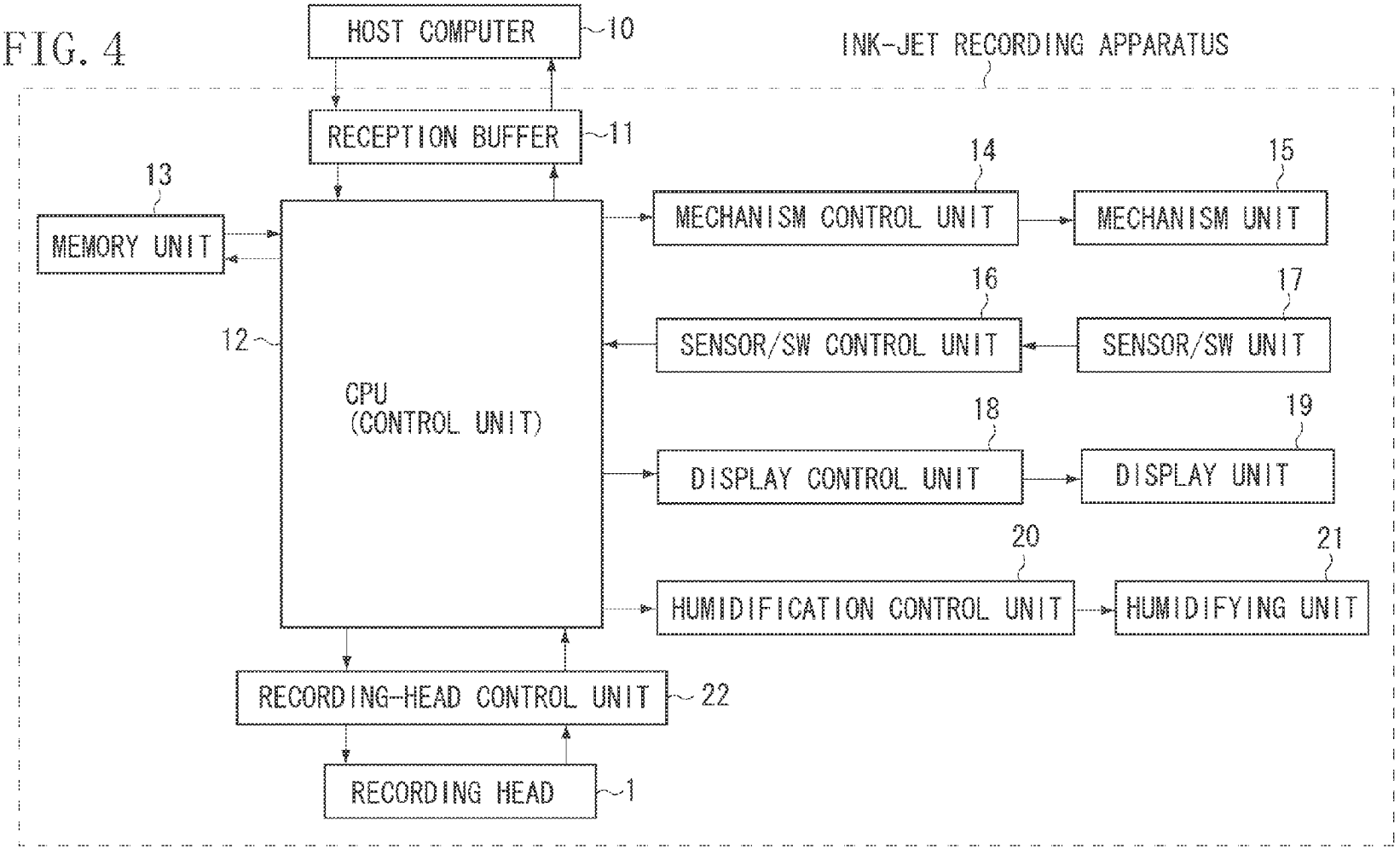
FIG. 4 is a block diagram illustrating a control system.

FIG. 4 is a block diagram illustrating a control system of an inkjet recording apparatus according to the present exemplary embodiment. Data such as characters and images to be recorded is input to a reception buffer 11 of the inkjet recording apparatus from a host computer 10. Data used to check errors in transfer of the data and to inform of operation state of the inkjet recording apparatus are output to the host computer 10 from the inkjet recording apparatus.

The data in the reception buffer 11 is transferred to a memory unit 13 and temporarily stored in a random access memory (RAM) under control of a central processing unit (CPU) 12. A mechanism control unit 14 drives a mechanism unit 15 including line head carriages, caps, and wipers, in response to commands from the CPU 12.

A sensor/switch (SW) control unit 16 sends signals to the CPU 12 from a sensor/SW unit 17 consisting of various sensors such as temperature and humidity sensors, and switches. A display control unit 18 controls a display unit 19 such as a liquid crystal display, in response to commands from the CPU 12.

The humidification control unit 20 controls a humidifying unit (i.e., the first humidifying unit 4 and the second humidifying unit 3) 21, in response to commands from the CPU 12. In this control, the CPU 12 determines the amount of moisture to be supplied to the sheet, based on various information such as ambient temperature, sheet type, sheet thickness, temperature of line head, volume of input image data to be recorded, to set humidifying conditions for the operation performed by a humidifying unit 21.

A recording-head control unit 22 drive-controls the recording heads 1, detects state information of the recording heads 1 such as temperature, and transmits the information to the CPU 12, in response to commands from the CPU 12.

With the structure described above, the first humidifying unit 4 is arranged upstream of the recording unit 9 along the sheet conveyance path, so that the first humidified gas is supplied to the sheet before the sheet enters the recording unit 9. This increases the moisture content of the sheet before the sheet enters the recording unit 9. The second humidifying unit 3 supplies the second humidified gas through the sheet entrance in such a manner that the humidified gas flows from the upstream to downstream along the conveyance path in the recording unit 9.

The second humidified gas is sent into the recording unit 9 in advance to the sheet feeding, to increase the atmosphere humidity in the narrow space where the nozzles of the recording heads 1 are exposed, and to moisturize the nozzles. As a procedure, in a first step, the first humidified gas is supplied through a first supply port to the conveyed sheet to increase moisture content of the sheet.

In a second step, the second humidified gas is supplied to the narrow space where the nozzles are exposed through a second supply port located at a position closer to the recording heads than the first supply port, to increase the atmosphere humidity in the narrow space, and moisturize the nozzles. In a third step, the sheet portion having the moisture content increased in the first step is advanced into the narrow space having the atmosphere humidity increased in the second step, and data is recorded on the sheet portion using the inkjet recording heads.

Through the steps, when the sheet passes through the space for recording, the sheet already has the increased moisture content due to the first humidified gas, thereby restraining the sheet from absorbing the moisture in the second humidified gas.

As a result, the narrow space from the upstream recording head to the downstream recording head is maintained at high humidity, which reliably moisturizes the nozzles. Consequently, defective ink discharge is prevented, such as discharge failure and discharge in wrong directions.

Figure 5:
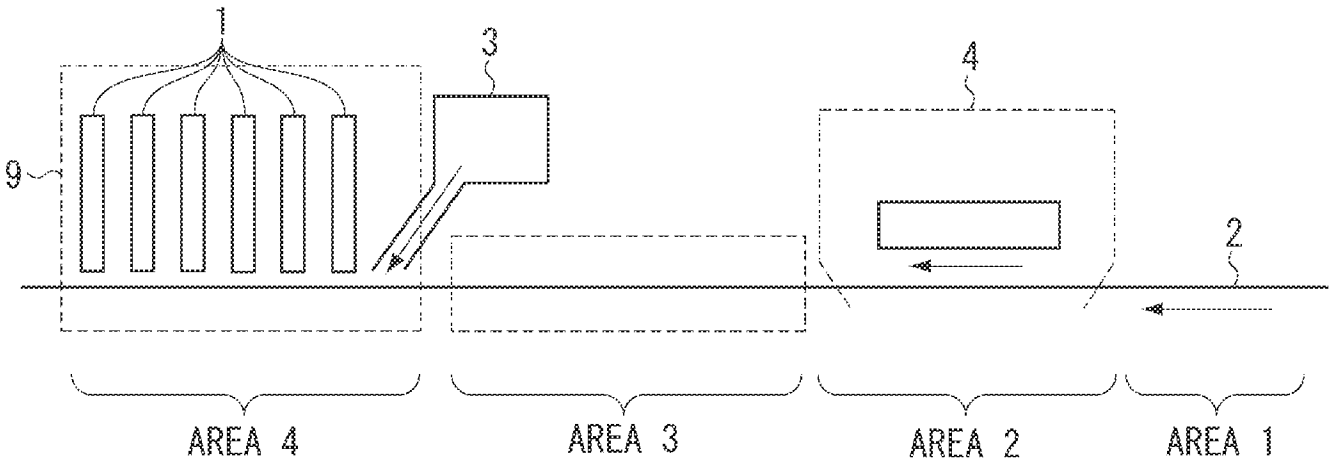
FIG. 5 schematically illustrates areas between a first humidifying unit 4 and a recording unit 9.

FIG. 5 schematically illustrates areas between the first humidifying unit 4 and the recording unit 9. The areas 1 to 4 are divided based on the changes in moisture content of the sheet. In the area 1, the sheet is unrolled prior to its entrance to the first humidifying unit 4. The sheet in the area 1 has a moisture content Q1 that is determined by the humidity and temperature in the housing of the recording apparatus.

In the area 2, the sheet is humidified by the first humidifying unit 4 before recording. At the end of the area 2 humidified by the first humidifying unit 4, the sheet has a moisture content Q2 larger than the moisture content Q1 by an absorbed moisture content ΔQ1 that was sprayed by the first humidifying unit 4 to the sheet: Q2=Q1+ΔQ1. The absorbed moisture content ΔQ1 varies depending on the temperature and humidity of the humidified gas (a first humidified gas) sprayed to the sheet in the area 2 and the period of time the sheet stays in the area 2.

In the area 3, the moisture content of the sheet humidified in advance in the area 2 is decreased. In the area 3, an amount of moisture ΔQ2 is desorbed from the sheet. As a result, at the end of the humidifying area 3 immediately before the entrance to the recording unit 9, the sheet has a moisture content Q3 smaller than the moisture content Q2: Q3=Q2−ΔQ2. The amount of desorbed moisture ΔQ2 varies depending on the temperature and humidity in the housing of the recording apparatus and the period of time the sheet stays in the area 3.

In the area 4, the humidified gas (a second humidified gas) is supplied from the second humidifying unit 3 from upstream to downstream in the space where the nozzles of the plurality of recording heads 1 are exposed in the recording unit 9. The sheet in the temperature and humidity in the area 4 has an equilibrium moisture content Q4.

If the sheet immediately before the entrance to the area 4 has a moisture content Q3 approximately equal to the equilibrium moisture content Q4, the sheet does not absorb moisture in the area 4, and thereby the sheet causes no decrease in humidity around the nozzles. Thus, controlling the moisture content Q3 not to be significantly smaller than the equilibrium moisture content Q4 leads to appropriate moisturizing of the nozzles of the recording heads 1.

From the above relationships Q3=Q2−ΔQ2 and Q2=Q1+ΔQ1, Q3=Q1+ΔQ1−ΔQ2 can be obtained. In other words, the moisture content Q3 is determined by the initial moisture content Q1, the absorbed moisture content ΔQ1 in the area 2, and the amount of desorbed moisture ΔQ2 in the area 3. Therefore, the ambient temperature and humidity in the recording apparatus, the temperature and humidity of the first humidified gas, and the periods of time the sheet stays in the areas 2 and 3, are set so that the moisture content Q3 is approximately equal to the equilibrium moisture content Q4.

The hysteresis of the sheet illustrated in FIG. 1 varies depending on the type of the sheet. In the cases of a sheet having larger moisture absorption property, the sheet may absorb much moisture in the area 4 to disturb appropriate moisturizing of the recording heads 1, because the relationship Q3=Q4 cannot be achieved but the equilibrium moisture content Q4 exceeds the moisture content Q3: Q3<Q4. Accordingly, in the present exemplary embodiment, according to at least one recording condition such as a type of the sheet used, an amount of humidification provided by the first humidified gas is variably set. There are several approaches to variably set an amount of humidification, which will be described below in sequence.

(Approach 1)

Figure 6:
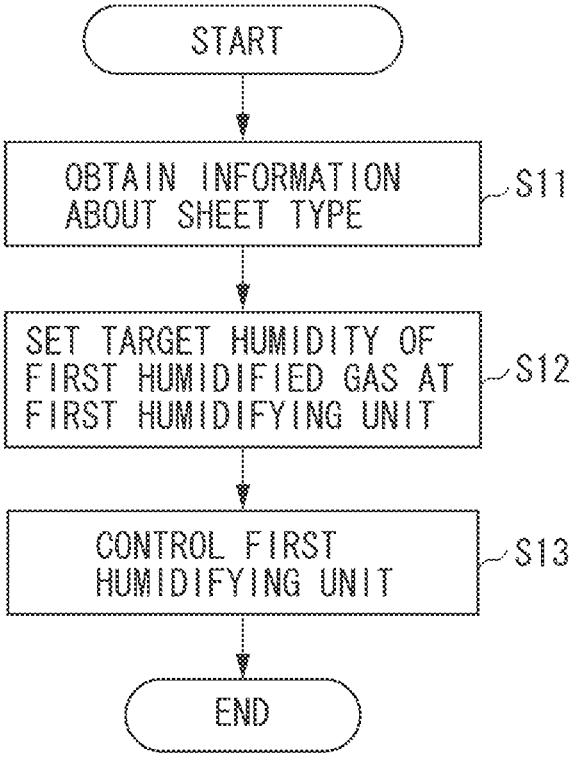
FIG. 6 is a flowchart illustrating a procedure to set and control a target humidity of a first humidified gas based on a sheet type.

In a first approach to variably set an amount of humidification, the humidity of the first humidified gas generated by the first humidifying unit 4 is variably controlled. A higher humidity of the humidified gas results in a larger amount of humidification. The flowchart in FIG. 6 illustrates a procedure to set and control a target humidity of the first humidified gas based on a sheet type.

In step S11, before recording, information about a sheet type is obtained using a sensor that detects the sheet type. As an example of the sensor, a medium sensor is known which optically reads a sheet surface using an optical sensor to determine a type of the sheet based on the obtained surface state information. Alternatively, the information about a sheet type may be obtained using sheet information specified by an operator, without using a sensor. Otherwise, the information about a sheet type may be obtained from information in a file that stores information about recording jobs.

The other known processes may be used. The following example is described when the sheet type is either glossy paper or semi-glossy paper. In this example, the glossy paper has baryta paper base, while the semi-glossy paper has RC paper base.

In step S12, according to the sheet type information obtained in step S11, a target temperature and humidity of the first humidified gas generated by the first humidifying unit 4 is set with reference to a data table stored in a memory in a control unit. Table 1 is a specific data table with parameters. Since the baryta paper has larger moisture absorption property than the RC paper, the glossy paper has a larger target humidity than the semi-glossy paper. The target temperatures are equal to each other in this example, but may be different.

TABLE 1

| Target Temperature and Humidity | | |
|---|---|---|
| Sheet Type | Glossy Paper (Baryta Paper) | Semi-Glossy Paper (RC Paper) |
| Target Temperature | 30° C. | 30° C. |
| Target Humidity | 85% | 75% |

In step S13, according to the target temperature and humidity set in step S12, the first humidifying unit 4 is controlled. Specifically, the humidification control unit 20 controls the humidifier 55 in FIG. 3 to variably generate humidified gas. Alternatively, while the preliminary humidification at the first humidifying unit 4 is controlled, an amount of humidification with the humidified gas supplied from the second humidifying unit 3 (the supply port 45) may be controlled to be variably set.

In the above sequence, since the glossy paper having larger moisture absorption property can be also sufficiently humidified in advance, the nozzles of the recording heads 1 are all appropriately moisturized during recording operation. In the case where semi-glossy paper is used, the amount of water consumed in the first humidifying unit 4 is small, thereby suppressing the electricity consumption in waste for generation of humidified gas, and decreasing the frequency to refill water for further reduction in running cost.

(Approach 2)

Figure 7:
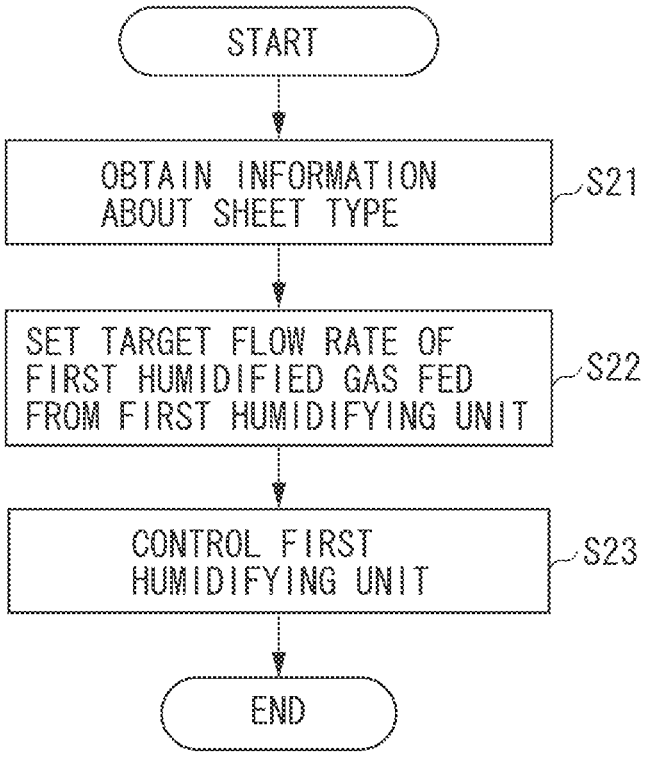
FIG. 7 is a flowchart illustrating a procedure to set and control a target flow rate per unit time of a first humidified gas based on a sheet type.

In a second approach to variably set an amount of humidification, a flow rate of the first humidified gas per unit time supplied from the first humidifying unit 4 is variably controlled. A larger flow rate results in a larger amount of humidification. The flowchart in FIG. 7 illustrates a procedure to set and control a target flow rate of the first humidified gas per unit time based on a sheet type.

In step S21, as in step S11 of FIG. 6, information about a sheet type is obtained. In step S22, according to the information about the sheet type obtained in step S21, a target flow rate of the humidified gas per unit time supplied from the first humidifying unit 4 is set with reference to a data table stored in the memory in the control unit. Table 2 is a specific data table with parameters. Since the baryta paper has larger moisture absorption properties than the RC paper, the target flow speed (which is proportional to flow rate) is set to be larger for the glossy paper than that for the semi-glossy paper to change a flow rate. The flow rate of the supplied humidified gas is change, but the temperature and humidity of the humidified gas are maintained constant (e.g., 30° C. and 85%).

TABLE 2

| Target Flow Rate | | |
|---|---|---|
| Sheet Type | Glossy Paper (Baryta Paper) | Semi-Glossy Paper (RC Paper) |
| Flow Speed (Flow Rate) | 1.2 m/sec | 0.3 m/sec |

In step S23, according to the target flow rate set in step S22, the first humidifying unit 4 is controlled. A change in flow rate per unit time is achieved by changing the capability of a blower device in the first humidifying unit 4, or changing the opening area formed in the supply port 43. The blower device capability or the opening area is variably controlled by the humidification control unit 20.

In the approach 2, the same effect as that of the approach 1 can be obtained. As compared to the approach 1, advantageously, the time required to change the amount of humidification is reduced. Thus, in the case where the sheet feeding unit 41 includes a plurality of rolls to selectively feed a sheet, change in the amount of humidification can be switched in a short period of time when the sheet roll to be used is switched.

(Approach 3)

Figure 8:
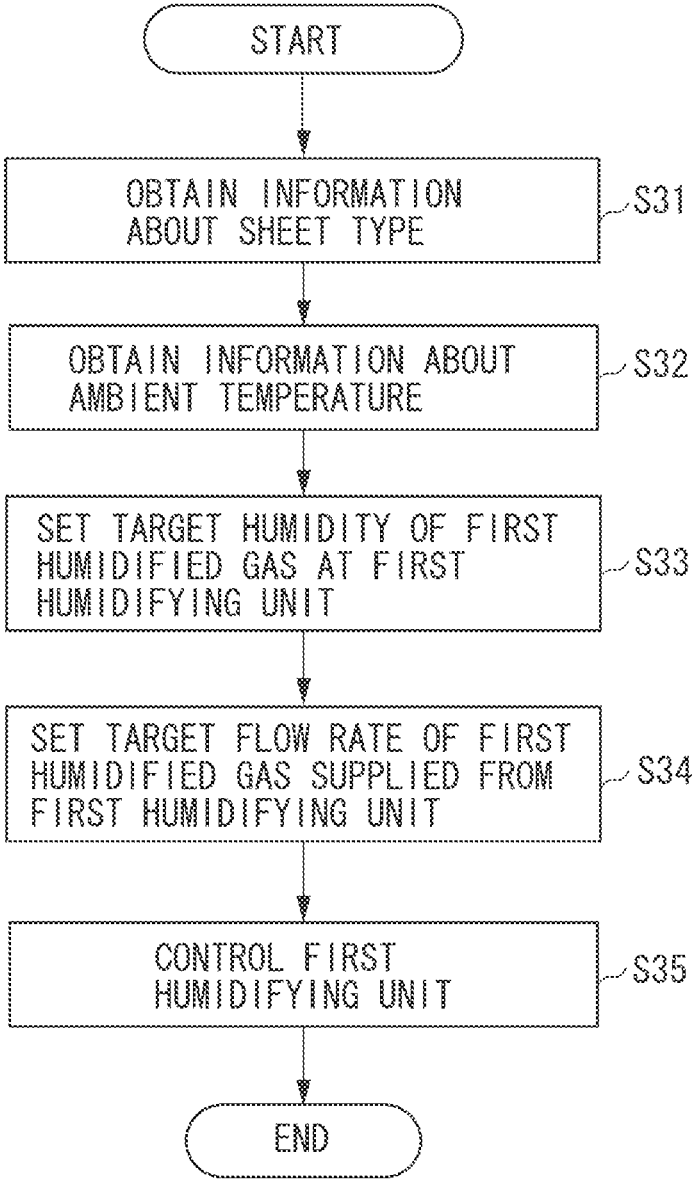
FIG. 8 is a flowchart illustrating a procedure to set and control a target humidity and a target flow rate per unit time of a first humidified gas based on a sheet type and an ambient temperature.

In a third approach to variably set an amount of humidification, a humidity of the first humidified gas generated by the first humidifying unit 4 is variably controlled, and also a flow rate of the first humidified gas per unit time supplied from the first humidifying unit 4 is variably controlled. Furthermore, these target values are changed in response to an ambient temperature. The flowchart in FIG. 8 illustrates a procedure to set and control these target values.

In step S31, like in step S11 of FIG. 6, information about a sheet type is obtained. In step S32, the information about the ambient temperature in the area where the sheet passes in the recording apparatus is obtained, based on the output of a temperature sensor located in the recording apparatus.

In step S33, according to the obtained information about the sheet type and the ambient temperature, a target temperature and humidity of the first humidified gas generated by the first humidifying unit 4 are set with reference to a data table stored in the memory in the control unit. In step S34, according to the obtained information about the sheet type and the ambient temperature, a target flow rate of the first humidified gas per unit time supplied from the first humidifying unit 4 is set with reference to a data table stored in the memory in the control unit.

Tables 3-1 and 3-2 illustrate examples of data table. Table 3-1 illustrates data for ambient temperature less than 25° C., while Table 3-2 illustrates data for ambient temperature of 25° C. or more, with difference in the target humidity and target flow rate.

The parameters in Tables 3-1 and 3-2 are set so that the amount of humidification is larger in a high temperature environment (at an ambient temperature of 25° C. or more) than in a low temperature environment (at an ambient temperature less than 25° C.). This is because that the initial moisture content Q1 in the area 1 and the amount of desorbed moisture ΔQ2 in the area 3 in FIG. 5 vary depending on an ambient temperature.

A lower ambient temperature results in a larger initial moisture content Q1 and a smaller amount of desorbed moisture ΔQ2. To control the moisture content Q3 of the sheet before the entrance to the recording unit 9 not to be significantly smaller than the equilibrium moisture content Q4, higher preliminary humidification at the first humidifying unit 4 is required. Accordingly, the amount of humidification to the sheet is set to be larger in the higher temperature environment (at an ambient temperature of 25° C. or more).

TABLE 3-1

| Cases at Ambient Temperature Less Than 25° C. | | |
|---|---|---|
| Sheet Type | Glossy Paper (Baryta Paper) | Semi-Glossy Paper (RC Paper) |
| Target Temperature | 30° C. | 30° C. |
| Target Humidity | 85% | 70% |
| Flow Speed (Flow Rate) | 1.0 m/sec | 0.3 m/sec |

TABLE 3-2

| Cases at Ambient Temperature of 25° C. or More | | |
|---|---|---|
| Sheet Type | Glossy Paper (Baryta Paper) | Semi-Glossy Paper (RC Paper) |
| Target Temperature | 30° C. | 30° C. |
| Target Humidity | 85% | 75% |
| Flow Speed (Flow Rate) | 1.2 m/sec | 0.4 m/sec |

In step S35, according to the target humidity and target flow rate set in step S22, the first humidifying unit 4 is controlled. Depending on the ambient temperature, not both but only one of the target humidity and the target flow rate may be variable.

According to this exemplary embodiment, in addition to the above effect, advantageously, parameters can be changed quickly in response to a change in ambient temperature during recording operation, resulting in reliable moisturization of the recording heads 1.

(Approach 4)

In a fourth approach to variably set an amount of humidification, the period of time the sheet stays in the humidifying area (area 2) in the first humidifying unit 4 is variably controlled. As a specific device to change a staying time of a sheet, a loop forming unit 60 is provided to form a loop in the sheet during its conveyance near the supply port 43, so that a change in the size of the loop changes a substantial staying time of the sheet in the humidifying area. A larger loop results in a longer staying time and a larger amount of humidification.

Figure 9A:
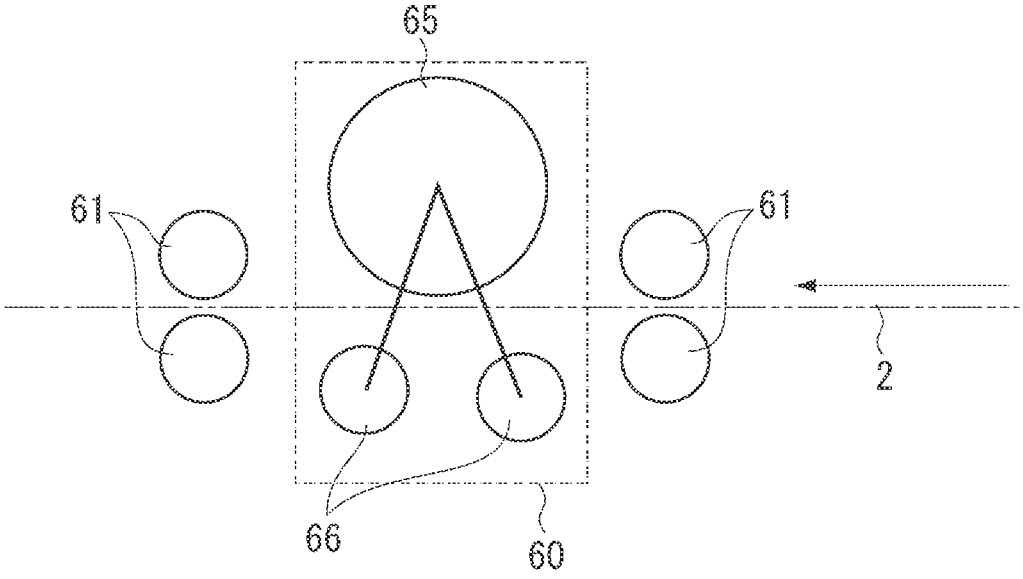
FIGS. 9A and 9B illustrate a configuration of a loop forming unit and an operation for loop formation.
Figure 9B:
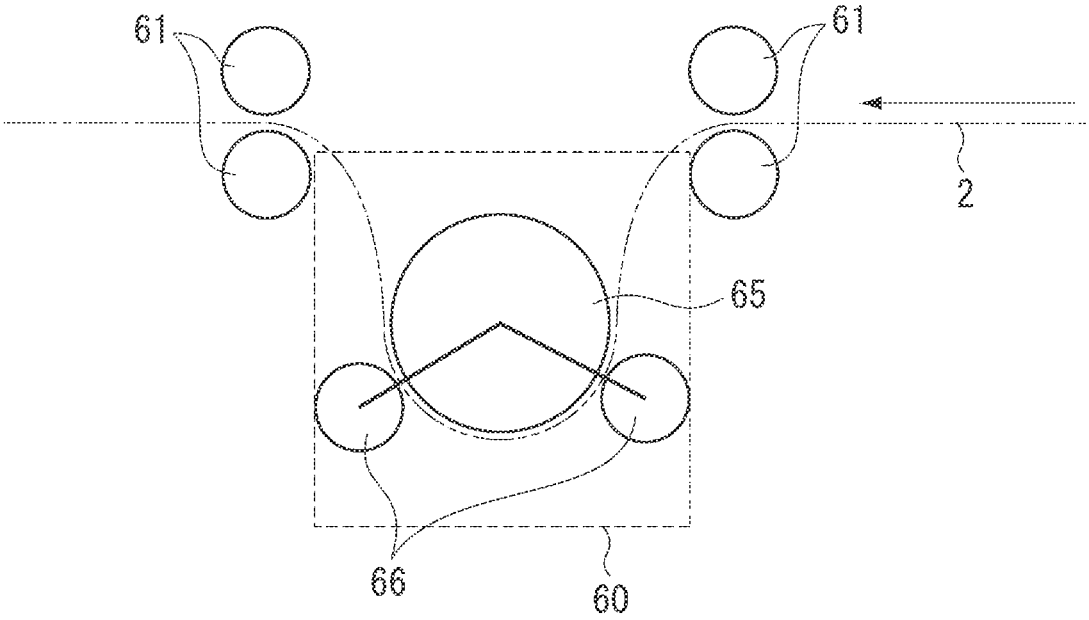
Figure 10A:
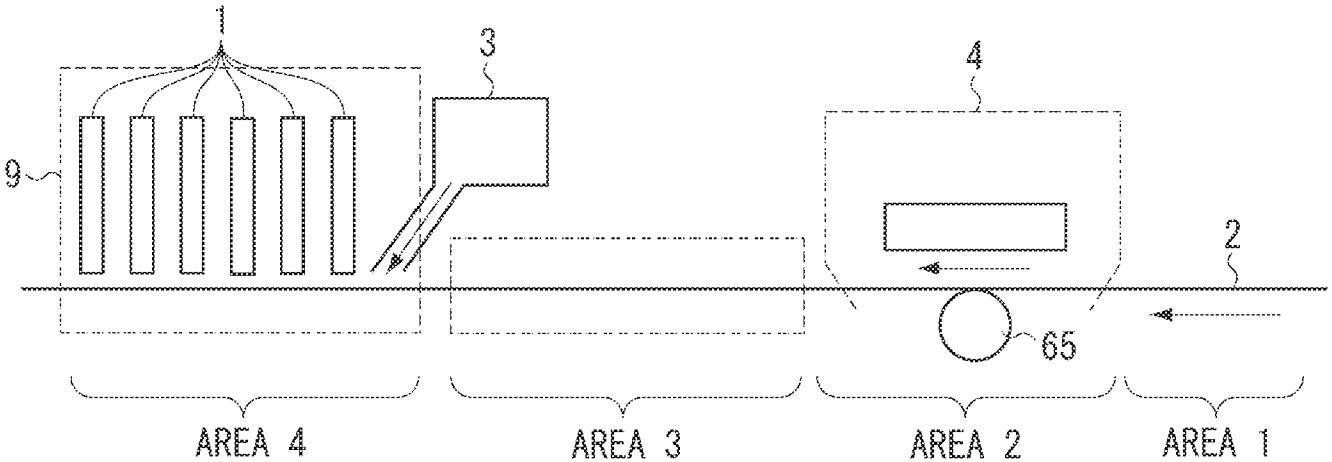
FIGS. 10A and 10B each illustrate a structure having a loop forming unit in an area 2.
Figure 10B:
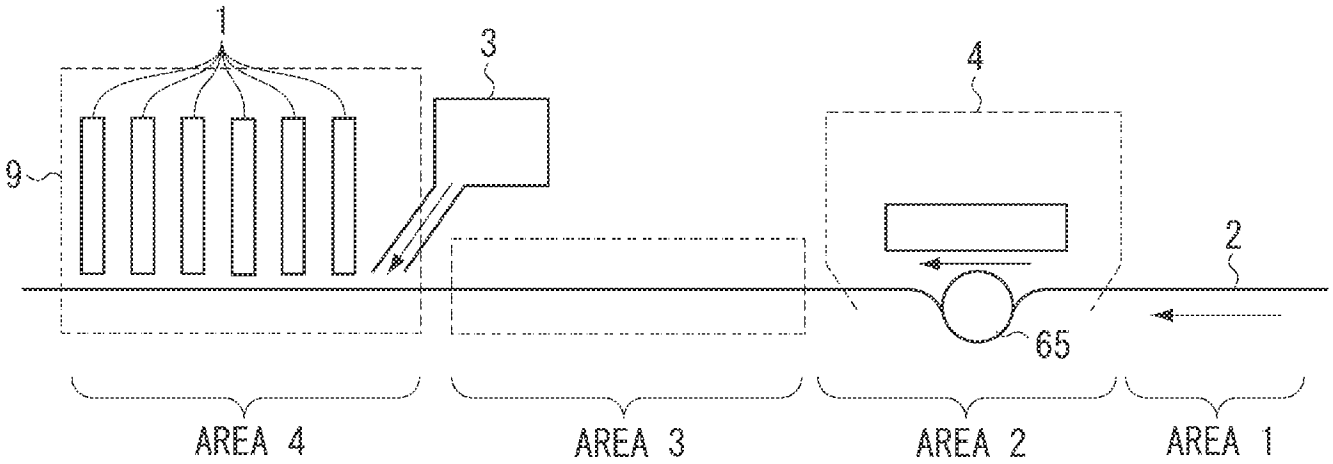

FIGS. 9A and 9B illustrate a configuration of a loop forming unit and an operation for loop formation. FIGS. 10A and 10B each illustrate a structure having a loop forming unit in the area 2 (a humidifying area in the first humidifying unit 4).

A loop forming unit 60 includes a loop forming roller 65 and two moving rollers movable around the loop forming roller 65. The loop forming roller 65 and the two moving rollers 66 do not have any driving force, and are driven to rotate. The sheet passes between the loop forming roller 65 and the moving rollers 66. Conveyance rollers 61 are disposed upstream and downstream of the loop forming unit 60 respectively along the direction of sheet conveyance. The loop forming roller 65 is moved vertically by a moving mechanism.

FIG. 9A and FIG. 10A illustrate the loop forming roller 65 located at an upper position to make the sheet pass through without loop formation. On the other hand, FIG. 9B and FIG. 10B illustrate the loop forming roller 65 located at a lower position to form a loop in the sheet.

As the loop forming roller 65 moves downward, the two moving rollers 66 moves as if they escape laterally. The sheet wraps around the lower half of the loop forming roller 65, and is also nipped between the loop forming roller 65 and the moving rollers 66. The depression of the sheet by the loop forming roller 65 corresponds to an increase in a length of the sheet conveyance path. The increased length of the sheet is referred to as "amount of loop".

Figure 12:
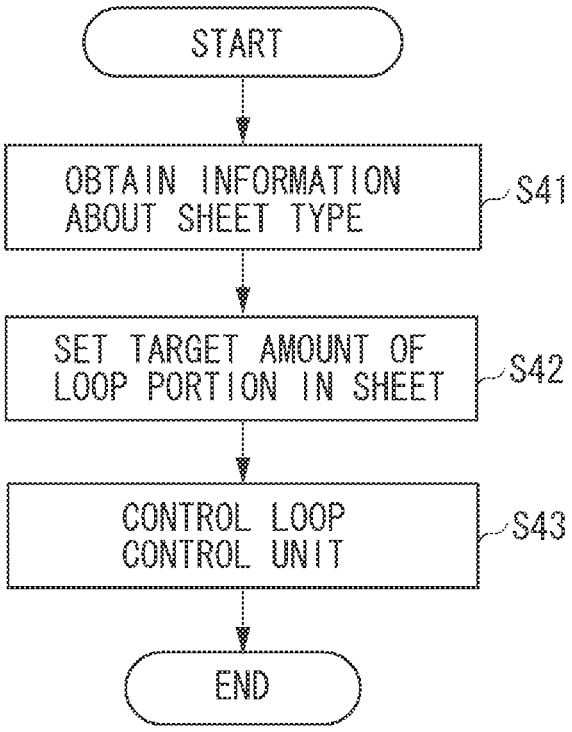
FIG. 12 is a flowchart illustrating a procedure to set and control a staying time of a sheet based on a sheet type.

FIG. 12 is a flowchart illustrating a procedure to set and control a staying time of a sheet based on a sheet type. In step S41, like in step S11 of FIG. 6, information about a sheet type is obtained.

In step S42, according to the information about sheet type obtained in step S11, a target amount of loop to be formed using the loop forming unit is set with reference to a data table stored in the memory in the control unit. Table 4 is a specific data table with parameters. The target amount of loop for glossy paper is larger than that for semi-glossy paper, because baryta paper has larger moisture absorption properties than RC paper.

TABLE 4

| Amount of Loop in Loop Forming Unit (Humidifying Area) | | |
|---|---|---|
| Sheet Type | Glossy Paper (Baryta Paper) | Semi-Glossy Paper (RC Paper) |
| Amount of Loop | 10 cm | 0 cm |

In step S43, according to the target amount of loop set in step S42, the loop forming unit is controlled. The mechanism control unit 14 in FIG. 4 controls the motor driving of the loop forming unit in the mechanism unit 15.

As described above, an amount of loop of the sheet, which is a length of the sheet conveyance path, can be changed in the humidifying area of the first humidifying unit 4. A larger length of the sheet conveyance path results in a longer staying time of the sheet in the humidifying area, and in turn a larger amount of humidification with the first humidified gas. As illustrated in Table 4, the glossy paper having larger moisture absorption property is also sufficiently humidified in advance, and thereby the nozzles of the recording heads 1 are all appropriately moisturized during recording operation.

An amount of humidification can be controlled only by forming a loop. Accordingly, as compared to the approach 1, advantageously, the time required to change an amount of humidification can be further reduced. When a continuous sheet is used, the loop forming unit located upstream of the recording unit contributes to increase stability of accuracy in conveying the sheet in the recording unit, leading to high recording accuracy.

(Approach 5)

Figure 11A:
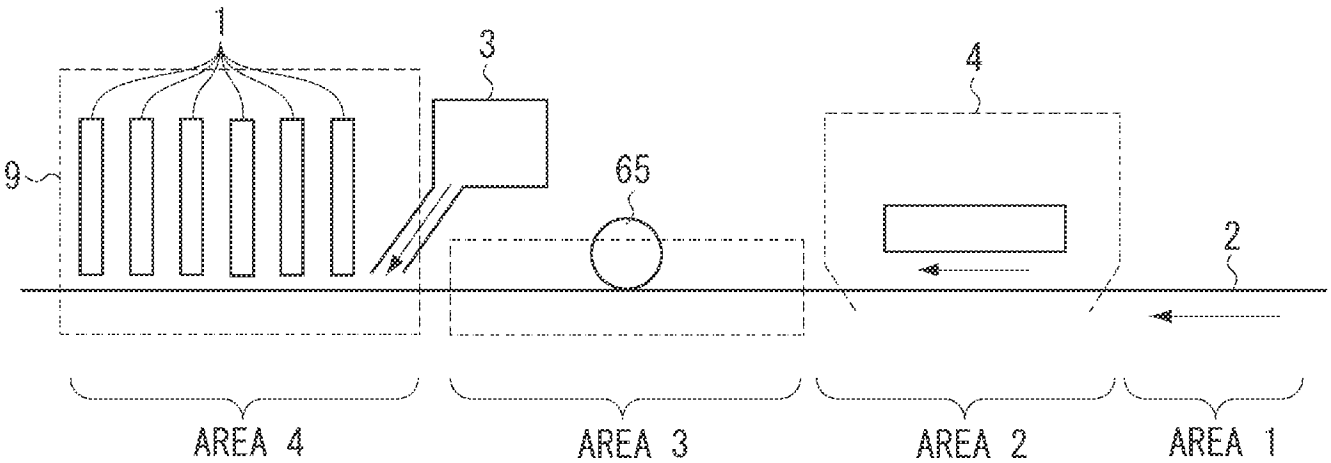
FIGS. 11A and 11B each illustrate a structure having a loop forming unit in an area 3.
Figure 11B:
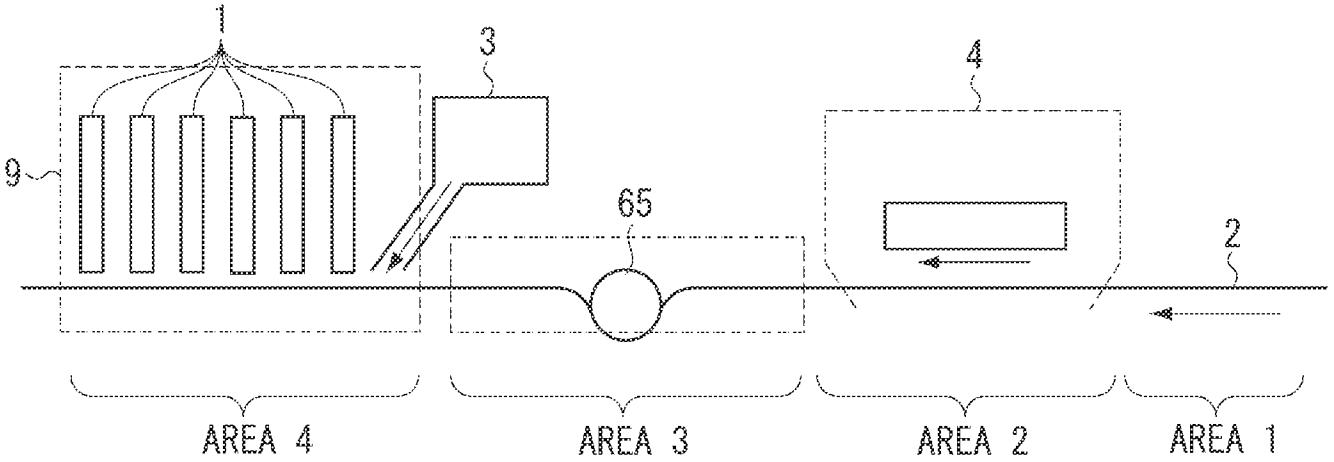

An approach 5 is a modification of the approach 4. FIGS. 11A and 11B illustrate a loop forming unit located in the area 3 (i.e., a non-humidifying area between the first supply port and the second supply port). The configuration and operation of the loop forming unit are identical to those described with reference to FIG. 9. FIG. 11A illustrates the loop forming roller 65 located at an upper position, and FIG. 11B illustrates the loop forming roller 65 located at a lower position to form a loop in a sheet.

In the area 3 that is a non-humidifying area, moisture is desorbed from the sheet. Thus, a longer staying time of the sheet in the area 3 results in a larger amount of desorption of moisture, decreasing a moisture content of the sheet. If the humidification in advance in the first humidifying unit 4 is excessive, the loop forming roller 65 in the area 3 can be used to form a loop in the sheet to cause desorption of the excessive moisture. In this way, a sheet of any type can enter the recording unit 9 with an appropriate moisture content Q3.

In the above exemplary embodiment, a preliminary humidification is controlled based on a sheet type. The humidification can be influenced by recording conditions other than sheet type. Examples of the conditions include sheet size, sheet thickness, coating on one or both side of a sheet, and continuous or discontinuous sheet form.

As for sheet size, a larger sheet size (area) increases an amount of moisture required to cause the entire sheet to reach its equilibrium moisture content. As for sheet thickness, a larger thickness increases an amount of moisture to be supplied. As for coating, a sheet having coating on both sides requires a larger amount of moisture than a one-side coated sheet.

As for sheet form, a continuous sheet without boundary requires a larger amount of moisture than cut sheets. Therefore, desirably these recording conditions are also considered in variably setting the amount of humidification with the first humidified gas.

The other recording conditions include a speed to convey a sheet during recording. A higher sheet-conveyance speed reduces a staying time of the sheet in the area 2, which may cause the sheet to enter the recording unit 9 before the equilibrium moisture content is not reached. In the case where the sheet-conveyance speed in the recording unit 9 is not regulated, desirably, the amount of humidification with the first humidified gas is variably set in response to the speed, as described above.

In the case, any of the above approaches illustrated in FIGS. 6 to 8 and FIG. 12 may be used to change an amount of humidification. Information about one of the recording conditions is obtained, instead of information about sheet type. Alternatively, two or more recording conditions may be combined as the information, so that the amount of humidification is variably set.

The above example uses a line printer having full-line inkjet recording heads that are fixed. The present invention is applicable to serial printers as well as line printers. In a serial printer, images are formed by alternate operations of scanning by recording heads and feeding a predetermined amount of sheet in a step.

The number of scanning (passes) by recording heads per step may be one or more depending on a recording mode. The amount of sheet movement per unit time, which is the average sheet conveying speed in a step, varies depending on the number of passes.

The number of recording passes substantially determines a sheet conveying speed: a larger number of passes decreases a sheet conveying speed. In a serial printer, since the sheet conveyance is stopped during scanning by the recording heads, the staying time of the sheet in the humidifying area of the first humidifying unit 4 varies depending on a recording mode (the number of passes). Accordingly, desirably, based on a sheet conveying speed as a recording condition, the amount of humidification with the first humidified gas is variably set, as described above.

A recording apparatus according to a second exemplary embodiment of the present invention is described. In the above exemplary embodiment, the amount of preliminary humidification with the first humidified gas is variably set based on a sheet type. On the other hand, in the present exemplary embodiment, a recording apparatus for duplex printing on a continuous sheet is used, in which the amount of preliminary humidification differs between recordings on a front surface (first side) and a rear surface (second side).

Figure 13A:
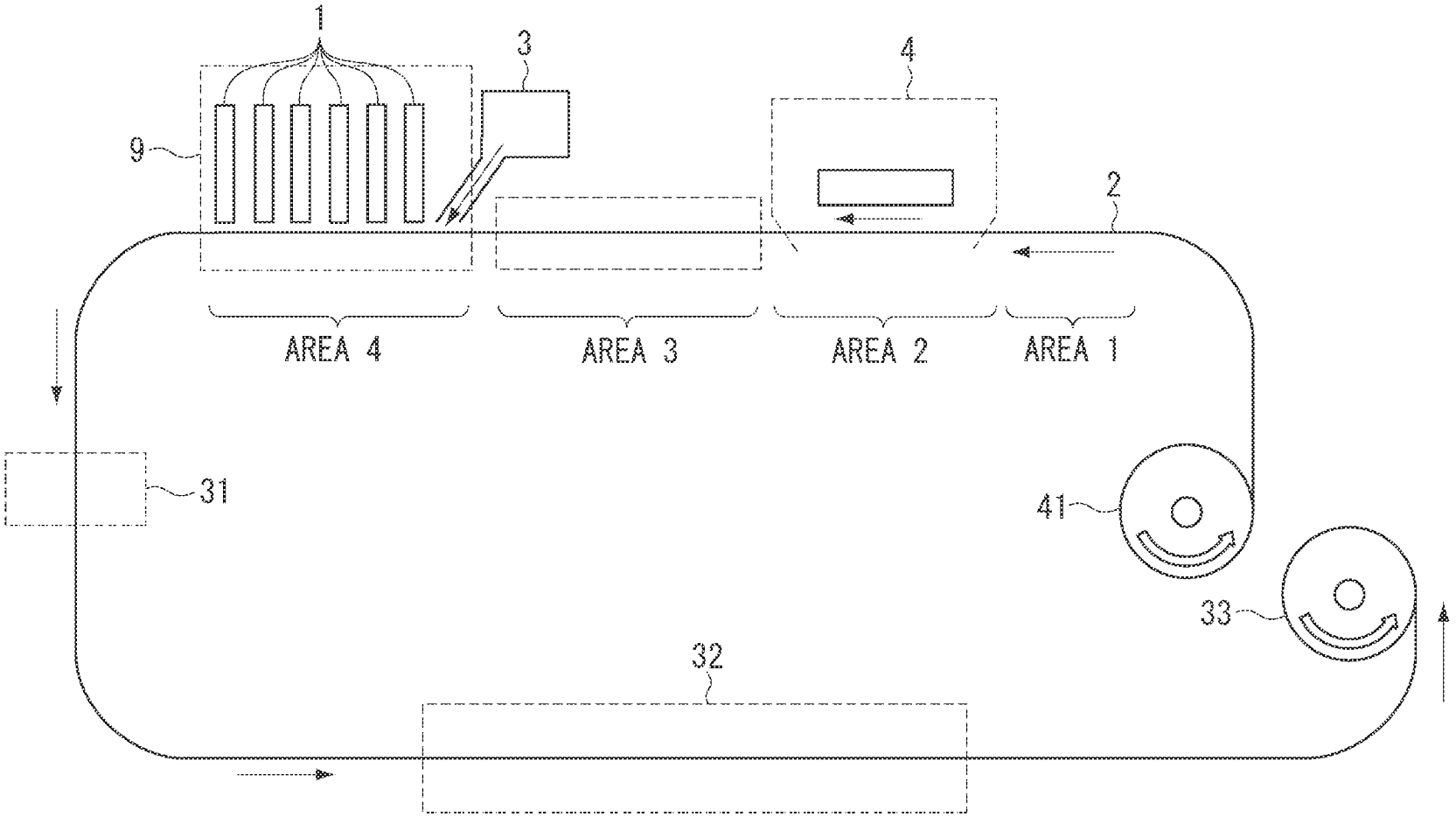
FIGS. 13A and 13B each illustrate a structure of a recording apparatus for duplex printing according to a second exemplary embodiment.
Figure 13B:
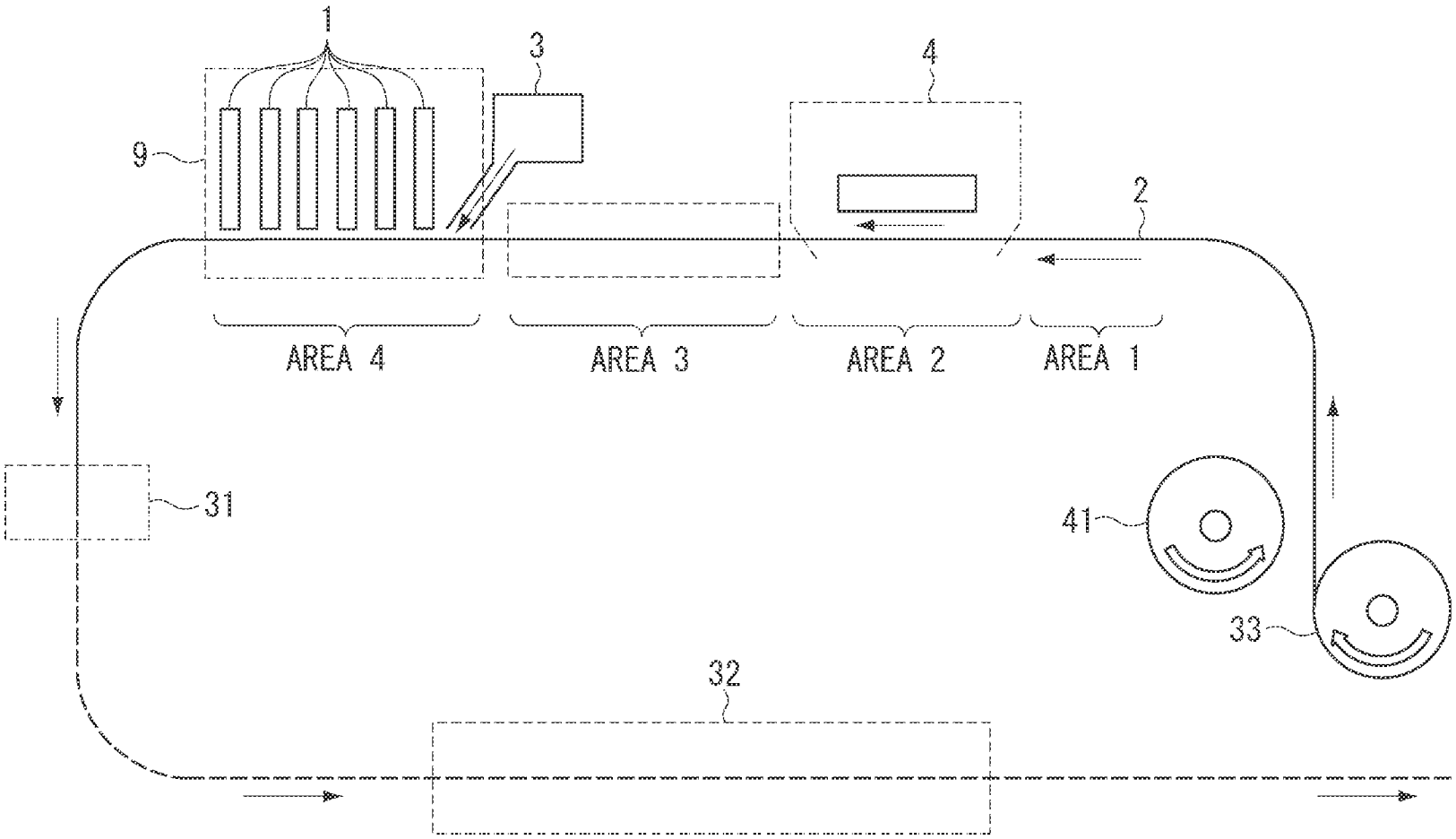

FIGS. 13A and 13B illustrate a structure of an entire recording apparatus for duplex printing according to the second exemplary embodiment. FIG. 13A illustrates an operation in a first-side recording mode to record a plurality of images in sequence on a first side of a continuous sheet. FIG. 13B illustrates an operation in a second-side recording mode to record a plurality of images in sequence on a second side of the continuous sheet.

The recording apparatus of the present exemplary embodiment has the same structure from a sheet feeding unit 41 to a recording unit 9 as those of the above exemplary embodiment, and has areas 1 to 4. The recording apparatus further includes a cutter unit 31, a drying unit 32, and a winding rotary unit 33. The winding rotary unit 33 serves as a reversing device that reverses two sides of a sheet upside down through temporal roll-up of the sheet.

The recording apparatus includes a humidifying apparatus similar to that described with reference to FIG. 3, except a drying unit 32 instead of the drying unit 52 in FIG. 3. The drying unit 32 discharges heated and humidified gas, which is reused in generation of humidified gas, thereby increasing the energy efficiency of the overall apparatus.

Figure 14:
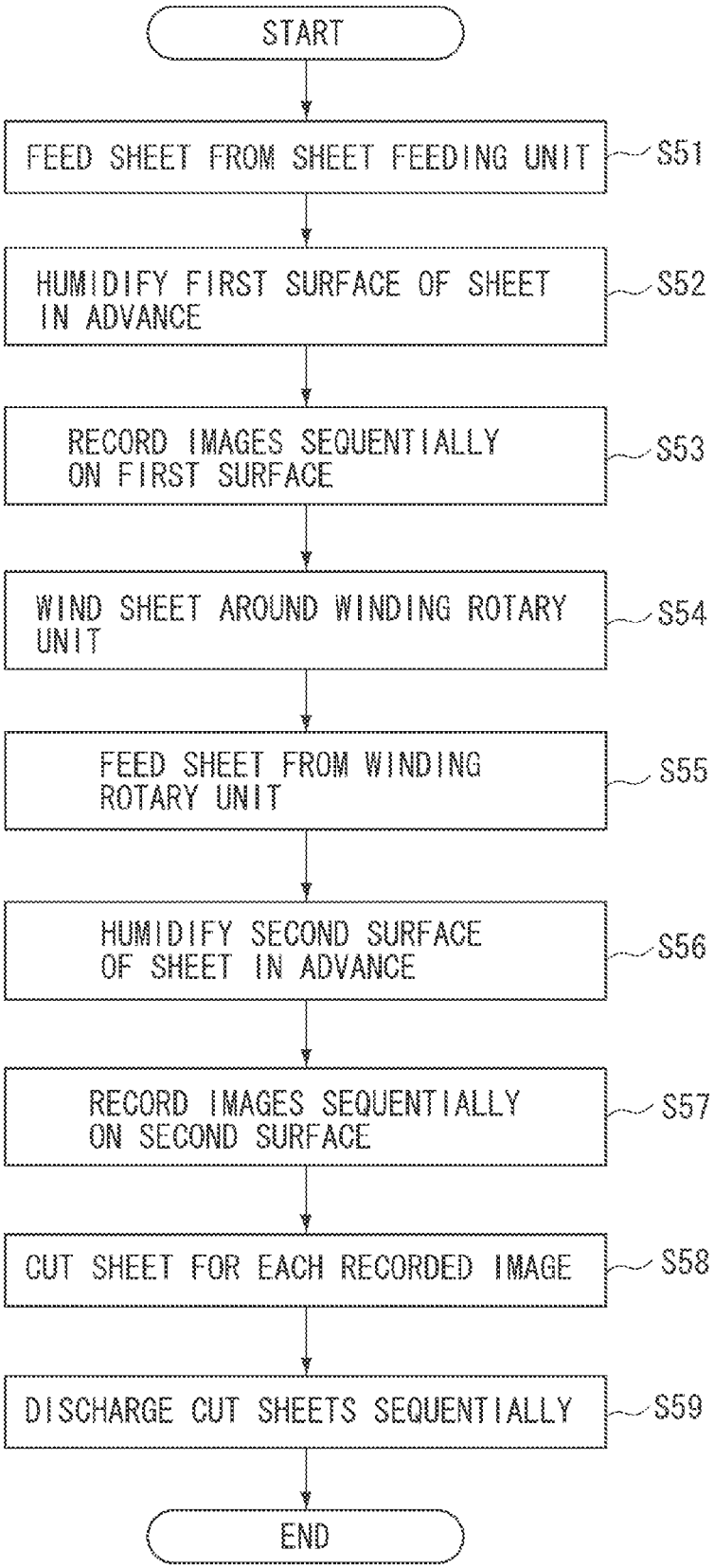
FIG. 14 is a flowchart illustrating an operation sequence of a duplex printing.

FIG. 14 is a flowchart illustrating an operation sequence of duplex printing. The sequence is executed under control of a control unit. In step S51, a sheet is supplied from a sheet feeding unit 41. The sheet is a continuous sheet with a first side facing upward.

In step S52, the first side of the sheet is humidified in advance by a first humidifying unit 4. As described in the first exemplary embodiment, an amount of humidification with a first humidified gas is variably set according to a sheet type used or the other recording conditions.

In step S53, a plurality of images are recorded in sequence on the first side of the sheet that is conveyed to a recording unit 9 after the preliminary humidification. The recorded images pass through the cutter unit 31 in the state of the continuous sheet to the drying unit 32, where the sheet portion with images are heated for drying. The drying unit 32 includes a blower that blows heated gas to the sheet.

In step S54, the sheet that has passed through the drying unit 32 is rolled up by the winding rotary unit 33 in the continuous form. For the roll-up, the winding rotary unit 33 rotates counterclockwise (FIG. 13A). The operations in step S51 to step S54 are repeated until a predetermined number of images are recorded or the entire sheet is used up.

When a predetermined number of images are recorded, the sheet is cut at the position behind the image recorded last by the cutter unit 31. The continuous sheet downstream of the cut position is all rolled up by the winding rotary unit 33. Simultaneously, the remaining continuous sheet located upstream of the cut position is back fed to be rolled up by the sheet feeding unit 41. The recording on the first side of the sheet is done here. Then, recording on the second side of the sheet is started.

In step S55, the winding rotary unit rotates in the opposite direction, that is, clockwise (FIG. 13B), so that the rolled-up sheet is supplied again to the area 1 as a continuous sheet. The sheet is conveyed upside down with the second side facing upward.

In step S56, the second side of the sheet is humidified in advance by a first humidifying unit 4. The amount of humidification with a first humidified gas is set to be different from that for the first side in step S52. To change the amount of humidification, any one of the approach 1 to 5 in the first exemplary embodiment may be used.

In step S57, a plurality of images corresponding to the images on the first side are recorded in sequence on the second side of the sheet that is conveyed to a recording unit 9 after the preliminary humidification. In step S58, the sheet is cut by the cutter unit 31 for each of the recorded image.

The cut sheets pass through the drying unit 32 for quick drying. In step S59, the cut sheets that have passed through the drying unit 32 are discharged one by one to the outside of the recording apparatus. In this way, a plurality of cut sheets having images on both sides are obtained, and the operation sequence for duplex printing ends.

In the above sequence, the sheet rolled up by the winding rotary unit 33 with recorded images on the first side is in the state after the processes for preliminary humidification, recording (application of ink), and drying are completed. Accordingly, the sheet has a moisture content different from the initial moisture content at the sheet feeding unit 41. The sheet of a desired thickness may have different moisture contents on the first and second sides thereof.

The moisture content on the second side is decreased when the sheet has passed through the drying unit 32 of high temperature after the first-side recording. In other words, the moisture content on the second side of the sheet in the second-side recording mode is likely to be lower than that of the first side in the first-side recording mode.

Accordingly, in the second preliminary humidification in step S57, the amount of humidification is increased as compared to that in the first preliminary humidification in step S52, to minimize the difference in the moisture content Q3 of the sheet between in the first-side recording mode and in the second-side recording mode, before the entrance to the recording unit 9

The above operation is effective when the drying unit 32 has an adequate capability for drying. The capability of the drying unit 32, however, may be very small, or the drying unit 32 may be eliminated in some structures. In these cases, the sheet having recording on the first side is inevitably rolled up by the winding rotary unit 33 without adequate drying.

When the sheet is supplied for the second-side recording, the moisture content of the second side of the sheet in the second-side recording mode is likely to be higher than that of the first side in the first-side recording mode. Thus, in the second preliminary humidification in step S57, the amount of humidification is decreased as compared to that in the first preliminary humidification in step S52, to minimize the difference in the moisture content Q3 of the sheet between in the first-side recording mode and in the second-side recording mode, before the entrance to the recording unit 9.

As described above, the amount of preliminary humidification is set to vary depending on whether the first-side recording mode or the second-side recording mode, in duplex printing. The relative size of the amounts of humidification is determined by presence/absence of the drying unit 32, its capacity for drying, and the other conditions unique to the apparatus. Consequently, in either mode, the nozzles in the recording heads are appropriately moisturized, and high quality images can be formed on the both of the first and second sides.

The benefit of both of the exemplary embodiments is that humidification of a sheet in advance suppresses moisture absorption by the sheet during recording, maintains recording heads at an appropriate moisture level, and prevents defective discharge of ink. In the humidification, the amount of humidification with humidified gas is variably set depending on recording conditions, resulting in more reliable moisturization of the recording heads.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A method for recording images on a sheet having a first and a second side, using at least one inkjet recording head having nozzles, comprising:

a first supply step of supplying a first humidified gas to the first side of the sheet, with a first supply port;

a humidifying step of supplying a second humidified gas to a space where the nozzles are exposed, with a second supply port located at a position closer to the recording head than the first supply port;

a first recording step of recording in the space where atmosphere humidity is increased, using the inkjet recording head, on the first side of the sheet having a moisture content increased in the first supply step;

a heating step of heating the sheet on which an image has been recorded on the first side for drying;

a second supply step of supplying the first humidified gas to the second side of the sheet having been heated in the heating step, with the first supply port; and a second recording step of recording in the space in which the second humidified gas is supplied, using the inkjet recording head, on the second side of the sheet having the moisture content increased in the second supply step, wherein an amount of humidification in the first supply step is different from that in the second supply step.

2. The method according to claim 1, wherein an amount of humidification in the second supply step is larger than that in the first supply step.

3. The method according to claim 2, wherein the sheet on which an image has been recorded on the second side is heated for drying.

* * * * *